US008291868B2

(12) United States Patent
Whallon

(10) Patent No.: US 8,291,868 B2
(45) Date of Patent: Oct. 23, 2012

(54) BRAKE FURNACE

(76) Inventor: Lester P. Whallon, Allegan, MI (US)

( * ) Notice: Subject to any disclaimer, the term of this patent is extended or adjusted under 35 U.S.C. 154(b) by 987 days.

(21) Appl. No.: 12/315,985

(22) Filed: Dec. 9, 2008

(65) Prior Publication Data

US 2010/0139577 A1 Jun. 10, 2010

(51) Int. Cl.
*F22B 3/06* (2006.01)
*F16D 65/80* (2006.01)
*F16D 65/813* (2006.01)

(52) U.S. Cl. ..... 122/26; 126/247; 188/264 CC

(58) Field of Classification Search ..... 126/247; 188/264 D, 264 CC; 122/26
See application file for complete search history.

(56) References Cited

U.S. PATENT DOCUMENTS 2,951,563 A * 9/1960 Bonham ..... 188/264 D
4,013,148 A * 3/1977 Kobelt ..... 188/264 D
4,554,906 A 11/1985 Newman, Sr. et al.
5,358,077 A * 10/1994 DeConti ..... 188/71.6
5,392,737 A 2/1995 Newman, Sr. et al.
5,419,306 A 5/1995 Huffman
5,819,724 A 10/1998 Hybertson
5,881,683 A * 3/1999 Ban et al. ..... 122/26
6,684,822 B1 2/2004 Lieggi
7,353,919 B2 4/2008 Christ
7,353,920 B2 4/2008 Nowak et al.
2009/0032344 A1 * 2/2009 Thompson ..... 188/264 D

* cited by examiner

*Primary Examiner* — Steven B McAllister
*Assistant Examiner* — John Bargero
(74) *Attorney, Agent, or Firm* — Frank D Lachenmaier

(57) ABSTRACT

The present invention relates to a method and apparatus for heating liquid for use in a radiant heating system. More specifically it relates to transferring heat generated from friction caused by pressing brake pads against rotating wheels to a thermally conductive liquid being pumped through said rotating wheels and circulating the heated liquid through a radiator type space heating system.

3 Claims, 6 Drawing Sheets

BRAKE FURNACE

BACKGROUND

1. Field of Invention

The present invention relates generally to radiant heating systems and more specifically to a unique furnace for heating liquid that circulates though a conventional radiator type system by transferring the heat generated from friction brake pads pressed against rotating wheels to thermally conductive liquid running through them.

2. Prior Art

The basic concept of circulating hot liquid through radiators is well known in the art. Gas and coal fired furnaces have been in use for many years as have electrical resistance heaters for heating the liquid. The concepts of running liquid through wheel brake caliper systems to cool the brakes and improve their efficiencies are also well known. The combination of these two divergent concepts, cooling the brake systems and heating liquid in a controlled fashion, however make this a unique approach to providing the heat needed to bring the circulating liquid to the appropriate temperature to heat a given size space with a given size radiator.

SUMMARY OF THE INVENTION

An object of the Brake Furnace is to provide an efficient heat source and heat transfer mechanism that is capable of raising the temperature of liquid in a closed loop system that circulates through a standard hot water radiator type room heating system.

Still further objects and advantages will become apparent from a consideration of the ensuing description and accompanying drawings. In the description, reference is made to the accompanying drawings which form a part thereof, and in which are shown by way of illustration a specific embodiment in which the invention may be practiced. This embodiment will be described in sufficient detail to enable those skilled in the art to practice this invention, and be understood that other embodiments may be utilized and that structural changes may be made without departing from the scope of the invention. In the accompanying drawings, like reference characters designate the same or similar parts throughout the several views.

DRAWINGS

The invention is described with reference to the following drawings.

Figure 1:
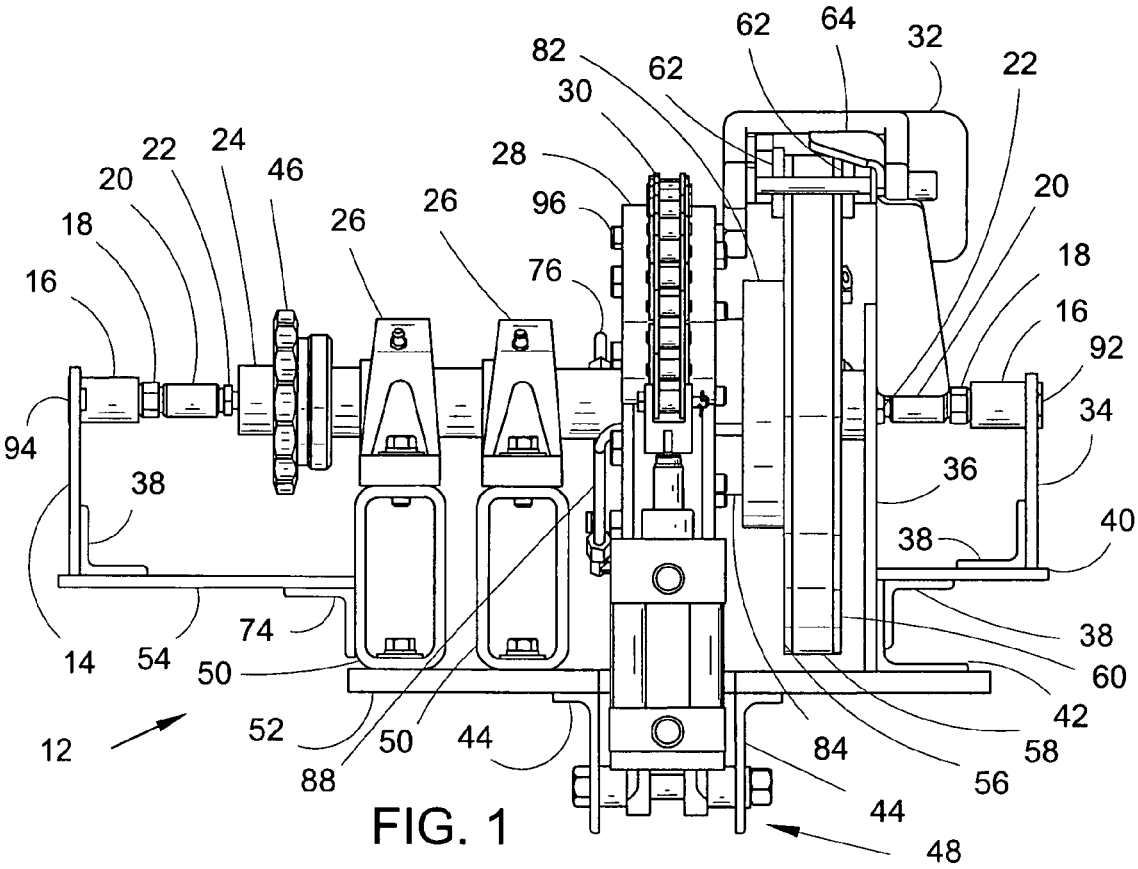
FIG. 1 is a front view of the Brake Furnace.

| REFERENCE NUMBERS: | |
|---|---|
| 12 | Brake Furnace |
| 14 | left end plate |
| 16 | manifold |
| 18 | manifold fitting |
| 20 | rotating chuck |
| 22 | chuck fitting |
| 24 | drive shaft |
| 26 | bearing assembly |
| 28 | large brake pad |
| 30 | chain |
| 32 | brake caliper |
| 34 | right end plate |
| 36 | caliper support plate |
| 38 | small L-bracket |
| 40 | right manifold support plate |
| 42 | large L-bracket |
| 44 | cylinder mounting bracket |
| 46 | drive means |
| 48 | cylinder assembly |
| 50 | bearing support |
| 52 | base plate |
| 54 | left manifold support plate |
| 56 | large wheel inner plate |
| 58 | large wheel |
| 60 | large wheel outer plate |
| 62 | small brake pad |
| 64 | brake caliper mounting bracket |
| 66 | small wheel back plate |
| 68 | small wheel front plate |
| 70 | small wheel |
| 72 | caliper mounting bolts |
| 74 | medium L-bracket |
| 76 | inlet tube to small wheel |
| 78 | drive means key |
| 80 | chain mount |
| 82 | spacer wheel |
| 84 | drive wheel |
| 86 | drive wheel key |
| 88 | outlet tube from small wheel |
| 90 | outlet tube from large wheel |
| 92 | outlet for brake furnace |
| 94 | inlet for brake furnace |
| 96 | cap screws |
| 98 | flat head screws |
| 100 | bolts |
| 102 | nuts |
| 104 | drive wheel key slot |
| 106 | large wheel outlet port |
| 108 | large wheel inlet port |
| 110 | drive means keyway |
| 112 | milled grooves |
| 114 | drive wheel keyway |
| 116 | tapped through holes |
| 118 | through holes |
| 120 | tapped holes |
| 122 | running channel |

DESCRIPTION

In order that the invention is fully understood it will now be described by way of the following examples in which Brake Furnace 12 is shown in FIGS. 1-9. Drive motor, water pump, hydraulic pressure pump for brake caliper and tensioning cylinder and controls are not shown or claimed as part of this invention as there are industry standards systems available to the artisan skilled in these trades.

FIGS. 1-5 disclose a two stage liquid heating Brake Furnace 12 that uses the heat generated from brake pads held in frictional contact with rotating wheels, transferring that heat to liquid being pumped through Brake Furnace 12, raising its temperature to a level needed to warm a given space to a controlled temperature using standard radiation techniques.

Left end support arrangement for Brake Furnace 12 is assembled on base plate 52 that is preferably constructed of ½ inch thick steel plate, approximately 14 inches long by 12 inches wide. Bearing supports 50 are preferably constructed of rectangular steel tubing approximately 4 inches tall by 2 inches wide and 7 inches long with ¼ inch thick side walls. First bearing support 50 is aligned with the left edge of the top surface of base plate 52 with the 7 inch dimension located centrally along the left end of base plate 52. Second bearing support 50 is positioned parallel to the first, approximately ⅝ inches inboard of first bearing support 50. Bearing assemblies 26 are mounted to the top surfaces of bearing supports 50, carefully aligning bearing assembly 26 centers. Medium L-bracket 74 is mounted on the left or outboard side in the front to back center of bearing support 50 at a height sufficient to allow latter component alignment with bearing assembly 26 centers. Medium L-bracket 74 is preferably a 3/16 inch thick by 1½ inch by 1½ inch angle approximately 4 inches long. Left manifold support plate 54 is mounted on the top surface of medium L-bracket 74 and is a rectangular steel plate, approximately 6½ inches long by 1¾ inches wide by ¼ inch thick. Small L-bracket 38 is attached to the top surface of left manifold support plate 54, approximately ½ inch from the outboard end of left manifold support plate 54. Left end plate 14 is attached to the vertical wall of small L-bracket 38 and is formed from a rectangular steel plate approximately ¼ inch thick by 1¾ inches wide and approximately 4 7/16 inches high with a centrally located U-shaped slot approximately ⅞ inch wide and 1 inch deep.

Right end support arrangement for Brake Furnace 12 is also assembled on base plate 52. Large L-bracket 42 is attached to the top surface of base plate 52, approximately 2½ inches from the right end of base plate 52. Large L-bracket 42 is preferably constructed from a 2 inch by 2 inch angle approximately 12 inches long and 3/16 inch thick. Caliper support plate 36 is mounted to the vertical face of large L-bracket 42. Caliper support plate 36 is preferably constructed of a ¼ inch thick steel plate, 12 inches wide by 8 inches high with a clearance notch approximately 2 inches wide by 3 inches deep, in top center to allow drive shaft 24 clearance. Centrally located with the horizontal surface parallel to the top of Large L-bracket 42 is small L-bracket 38. On the horizontal surface of small L-bracket 38 is mounted right manifold support plate 40. Right manifold support plate 40 is preferably constructed of a ¼ inch thick rectangular plate, 3¾ inches long by 1½ inches wide. Small L-bracket 38 is located on the top surface of right manifold support plate 40, 3¼ inches from the outboard wall. Mounted to the vertical surface of small L-bracket 38 is right end plate 34 which is preferably constructed from a rectangular steel plate ¼ inch thick and 1½ inches wide by 4¼ inch high with a centrally located U-shaped slot, having the same dimensions as the U-shaped slot in left end plate 14.

Drive shaft 24 is the base for all the rotating liquid moving assemblies. Drive shaft 24 is a 1½ inch diameter steel rod, approximately 14 inches long. Approximately ½ inch from the left end of drive shat 24 begins drive means keyway 110. When drive means key 78 is engaged between drive means keyway 110 in drive means 46 and drive shaft 24 and drive means 46 is caused to rotate, drive shaft 24 rotates synchronously. Approximately 2½ inches from the left end of drive shaft 24 starts drive wheel keyway 114. When drive wheel key 86 is engaged between drive wheel keyway 114 and drive wheel key slot 104 and drive means 46 is caused to rotate, all of the wheel assemblies rotate synchronously.

Drive shaft 24 has a liquid carrying lumen drilled and tapped that extends from the left end of drive shaft 24 to approximately 8 inches in depth as to align with cross drilled and tapped holes for fittings for inlet tube to small wheel 76. Drive shaft 24 also has a liquid carrying lumen drilled and tapped in the right end approximately 1½ inches in depth as to align with cross drilled and tapped holes for fittings for outlet tube from large wheel 90.

Attached to the left and right ends of drive shaft 24 are chuck fittings 22. Fastened outboard of each of chuck fittings 22 are rotating chucks 20 with manifold fittings 18 attached to their outboard ends. Finally, attached to the outboard end of manifold fittings 18 are 1 inch diameter manifolds 16 with 1/16 inch flats on opposing sides.

Figure 6:
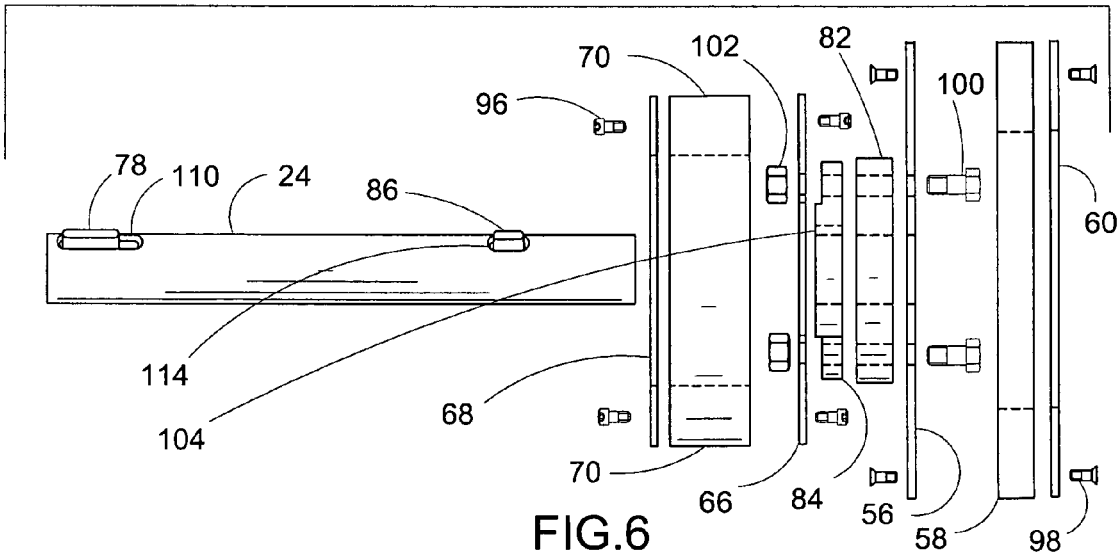
FIG. 6 is a partial exploded side view showing assembly of the wheels and their connection to the drive shaft.

FIG. 6 shows the wheel assembly onto drive shaft 24 in an exploded view for clarification. Large wheel inner plate 56 is fastened to the inner side of large wheel 58 preferably with 10-24×½ inch flat head screws 98, in 37 places in drilled and tapped through holes 116. The flat heads are required to provide a smooth surface for brake pads 62 to slide over as brake pads 62 interface with the outside surface of inner plate 56 when it rotates. Four bolts 100 are inserted through diametrically opposed clearance holes in large wheel inner plate 56, spacer wheel 82, drive wheel 84 and small wheel back plate 66 and the assembly completed by placing nuts 102 over bolts 100 and tightening. Small wheel back plate 66 and small wheel front plate 68 are attached to the back and front surfaces of small wheel 70, preferably with 10-24×½ inch socket head cap screws, 18 places per side in tapped holes 120. Large wheel outer plate 60 is attached to the outer surface of large wheel 58 preferably with 10-24×½ inch flat head screws 98 in 37 places in drilled and tapped through holes 116. Since all wheels are fastened together and keyed to drive shaft 24, all wheels rotate synchronously with drive shaft 24. Spacer wheel 82 is preferably constructed from an aluminum wheel approximately 5% inches in diameter by ⅞ inch thick with four clearance holes diametrically opposed on a 4 inch diameter bolt circle. Drive wheel 84 is preferably constructed from ⅞ inch thick, 5% inch diameter tool steel with a step down in diameter to allow interface with small wheel back plate 66 inner diameter with attendant mass savings.

Figure 7:
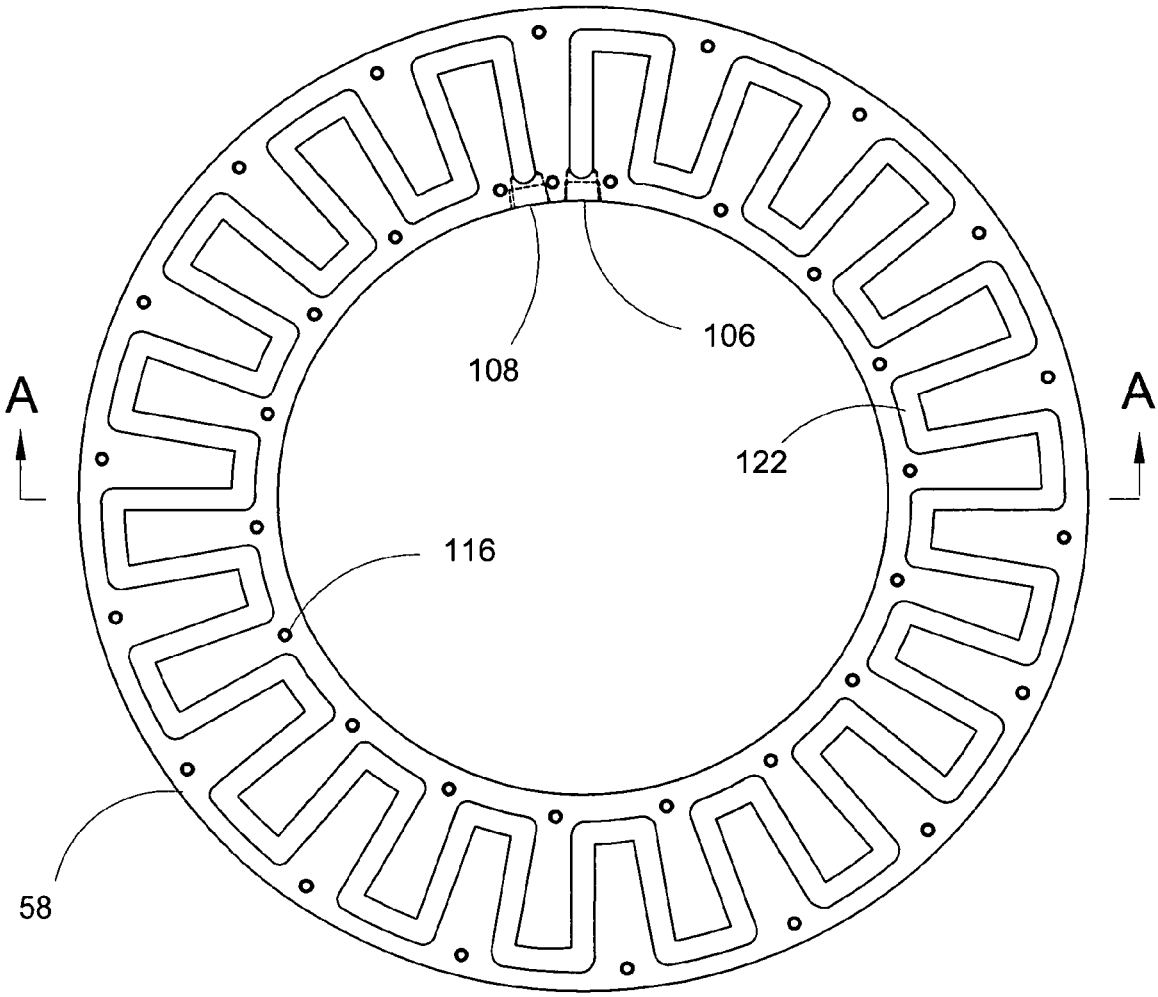
FIG. 7 is an enlarged front view of large wheel.
Figure 7A:
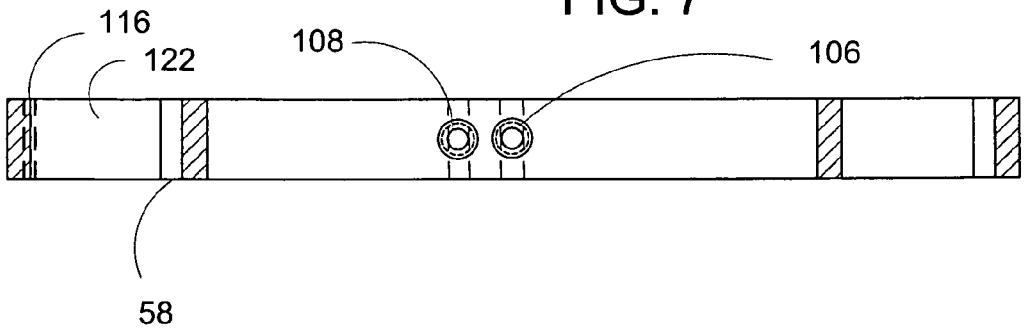
FIG. 7A is a section view taken along section line A-A.
Figure 8:
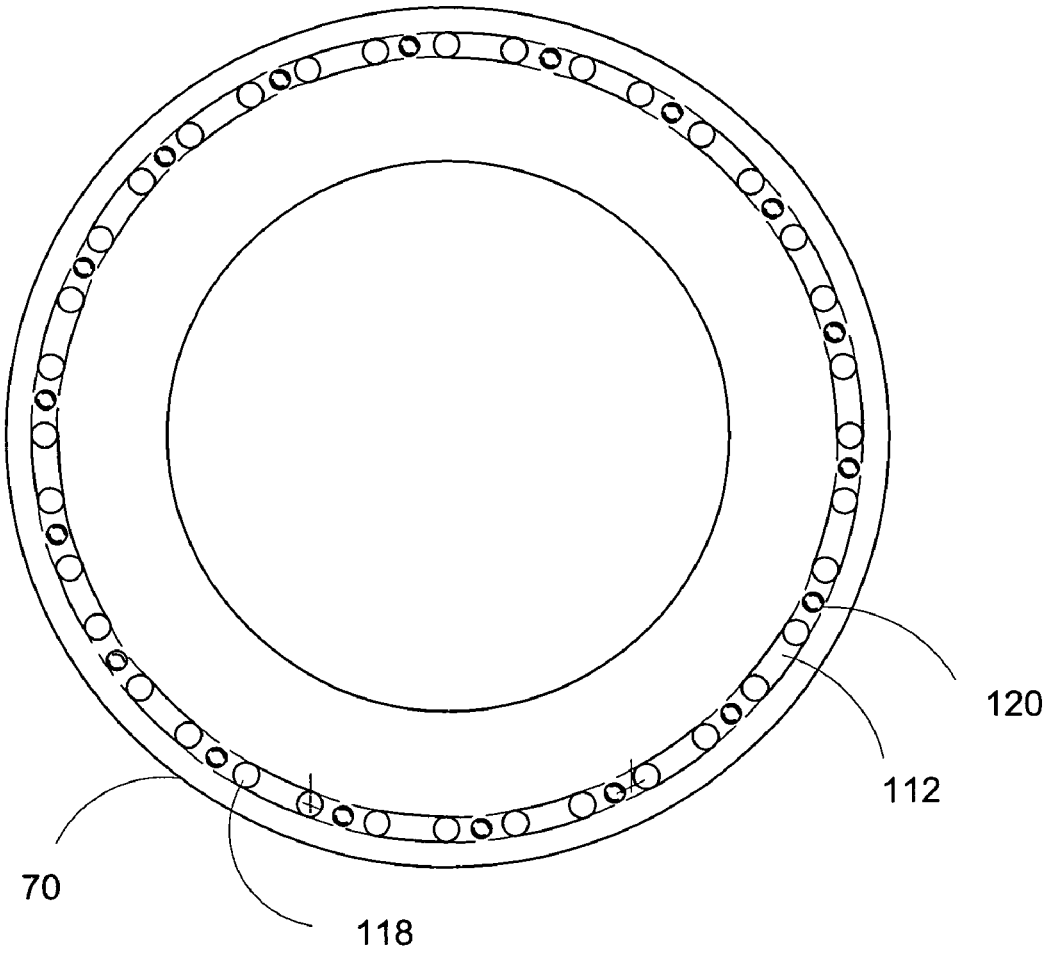
FIG. 8 is an enlarged front view of small wheel.
Figure 8A:
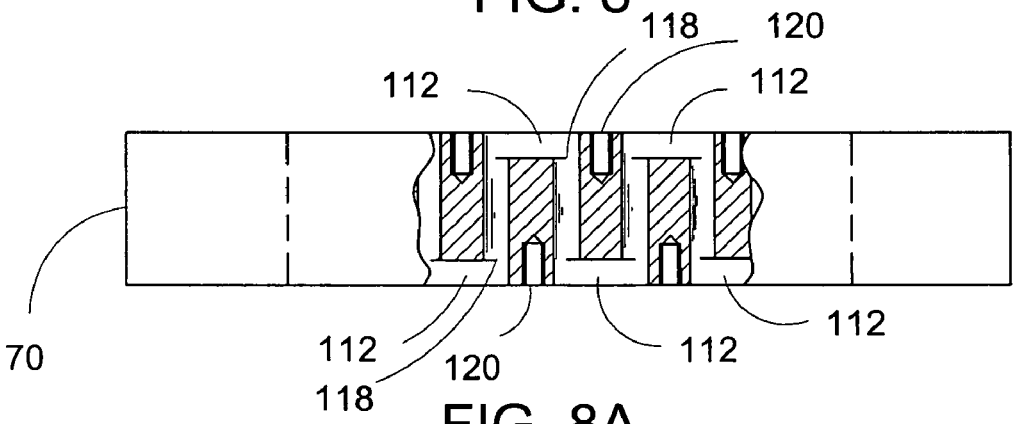
FIG. 8A is an enlarged side view with a partial section view of small wheel showing milled grooves, through holes and tapped holes for screws.
Figure 9:
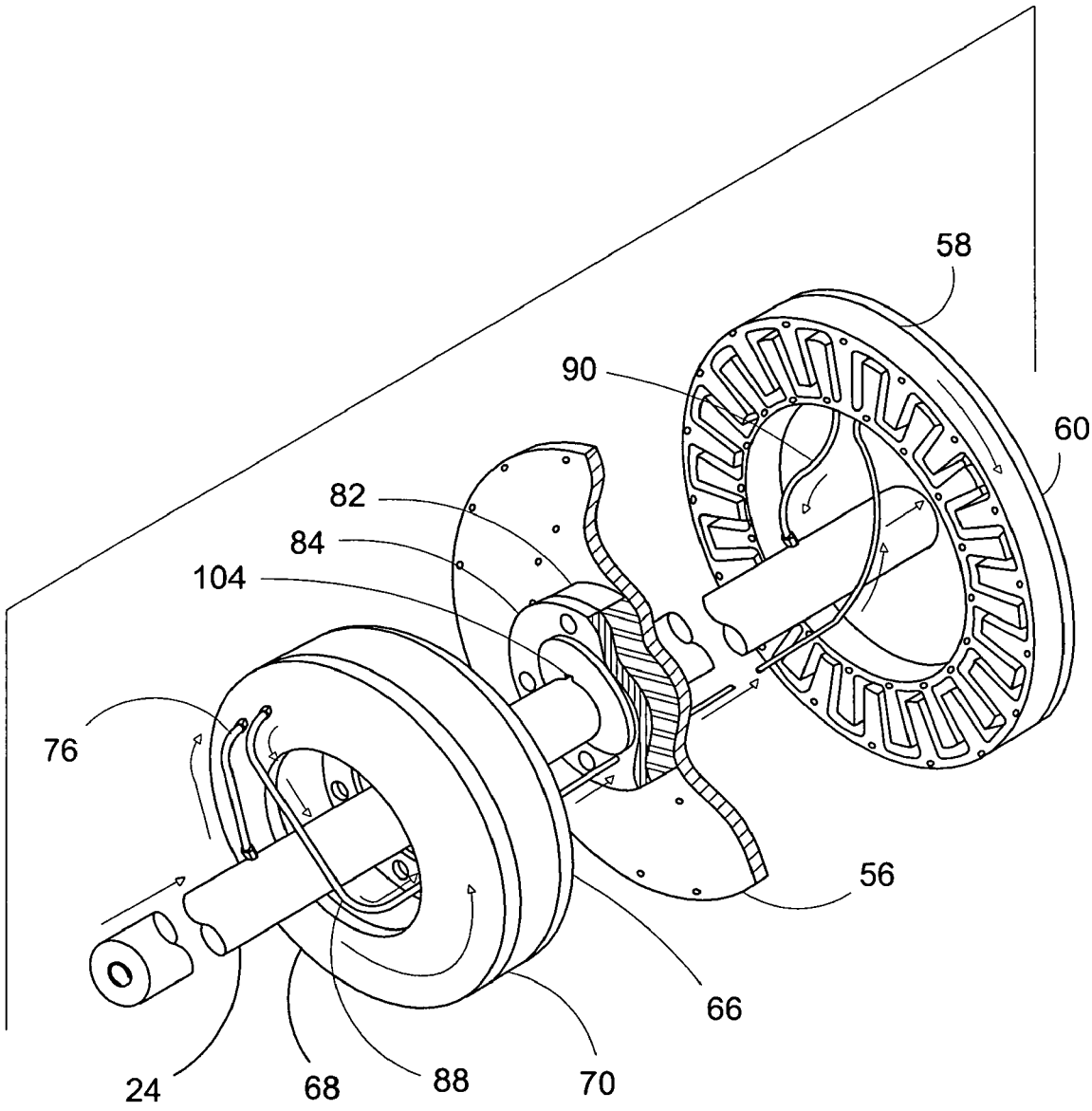
FIG. 9 is a partial perspective view showing large and small wheels, spacer wheel, drive wheel, the drive shaft and the liquid flow pattern through the furnace.

FIG. 9 shows in a broken perspective view the liquid flow path through Brake Furnace 12. Beginning with the left end of drive shaft 24, liquid is pumped into tapped hole in the center of drive shaft 24 and flows down the lumen in the center of drive shaft 24 until it breaks into cross drilled and tapped hole for fittings for inlet tube to small wheel 76. Liquid travels through tube 76 and enters small wheel 70 through fittings in small wheel front plate 68, breaking into one of the ¼ inch diameter through holes 118 leading to ¼ inch deep milled groove 112, descending through the adjacent ¼ inch diameter through hole 118, traveling across 114 inch deep milled groove 112 on backside, returning to front side through adjacent ¼ inch diameter through hole 118, progressing thusly around annular ring of small wheel 70. When the liquid completes its journey around small wheel 70 it exits through fittings in small wheel front plate 66 into outlet tube from small wheel 88. Outlet tube from small wheel 88 then carries the liquid through clearance holes in drive wheel 84, spacer wheel 82, and large wheel inner plate 56, parallel to drive shaft 24. When outlet tube from small wheel 88 clears the outer surface of large wheel inner plate 56 it turns upward and enters a fitting in the center of the width of large wheel 58 at large wheel inlet port 108. Large wheel 58 is preferably constructed of a 10⅞ inch diameter aluminum wheel with running channel 122 approximately ¼ inch wide cut through, starting at large wheel inlet port 108 moving from within/1;4 inch from Inner diameter to within ¼ inch of outer diameter of annular ring as shown in FIGS. 7 and 7A. Running channel 122 continues until it runs into large wheel outlet port 106 and exits through fittings at large wheel outlet port 106 to outlet tube to drive shaft 90. Liquid then flows through outlet tube to drive shaft 90 back into drive shaft 24 at the cross drilled and tapped hole toward the right end of drive shaft 24 and exits drive shaft 24 through lumen drilled into the right end of drive shaft 24 that intersects with above mentioned cross-drilled hole in the center of drive shaft 24.

Figure 2:
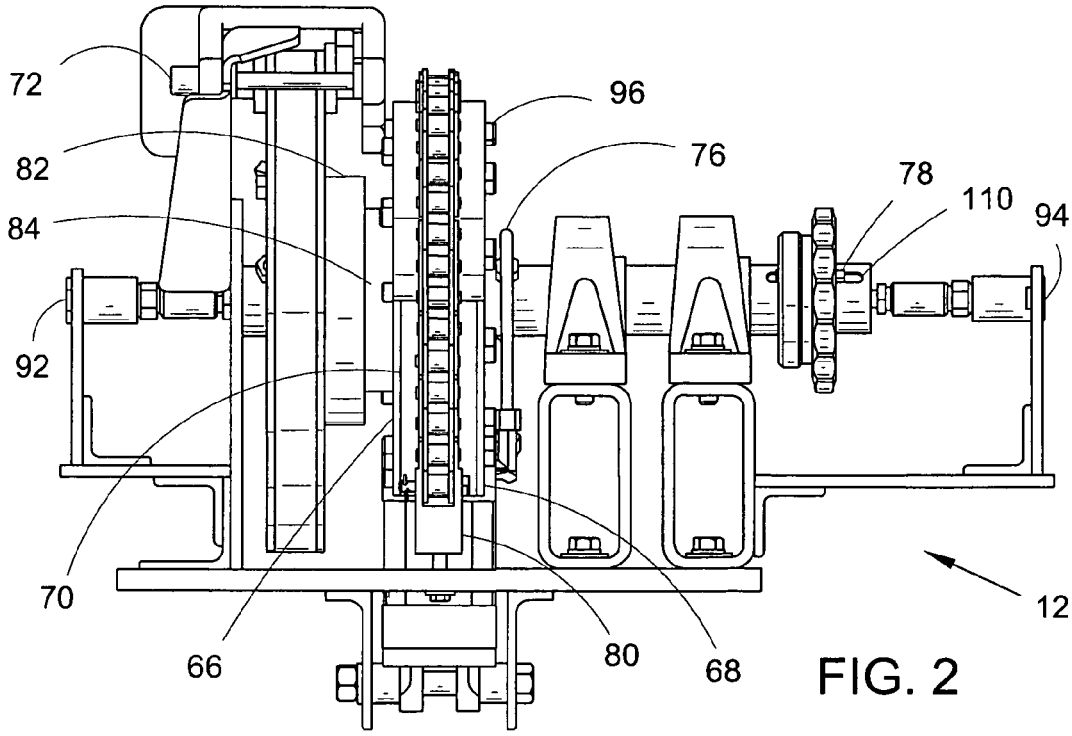
FIG. 2 is a rear view.
Figure 3:
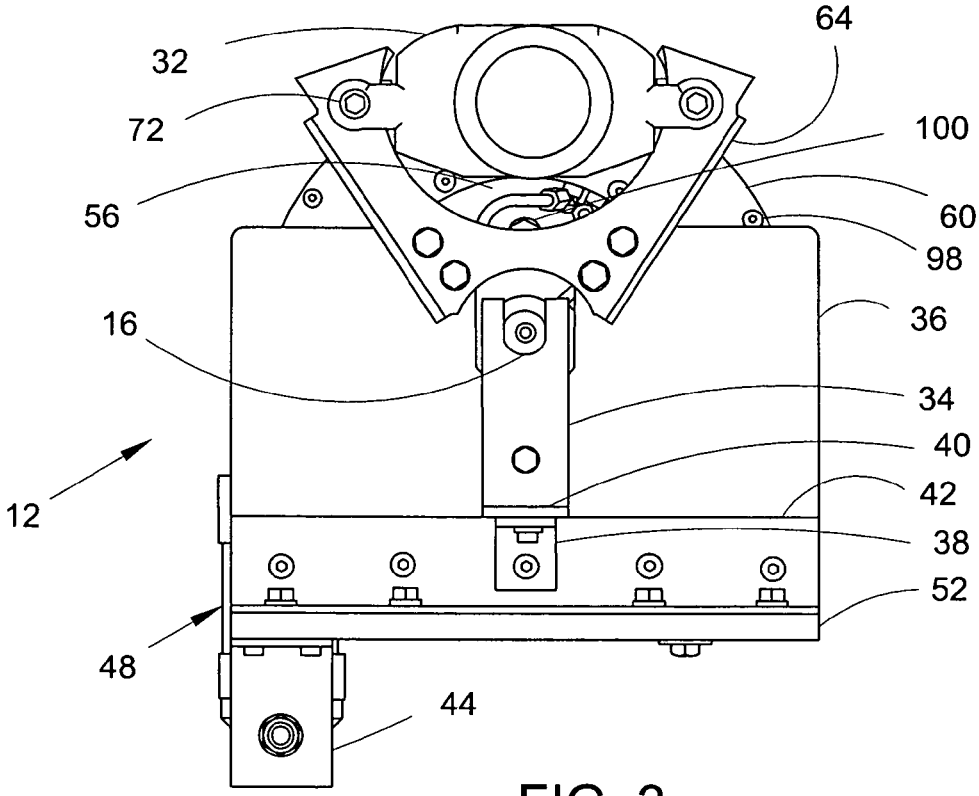
FIG. 3 is a right side view.
Figure 4:
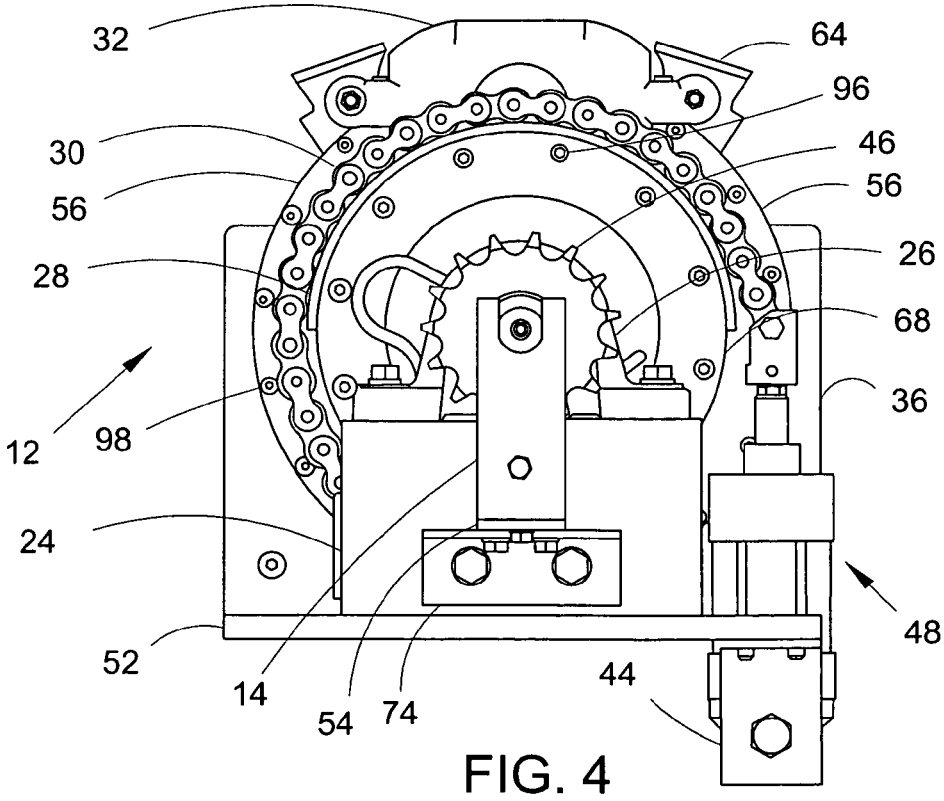
FIG. 4 is a left side view.
Figure 5:
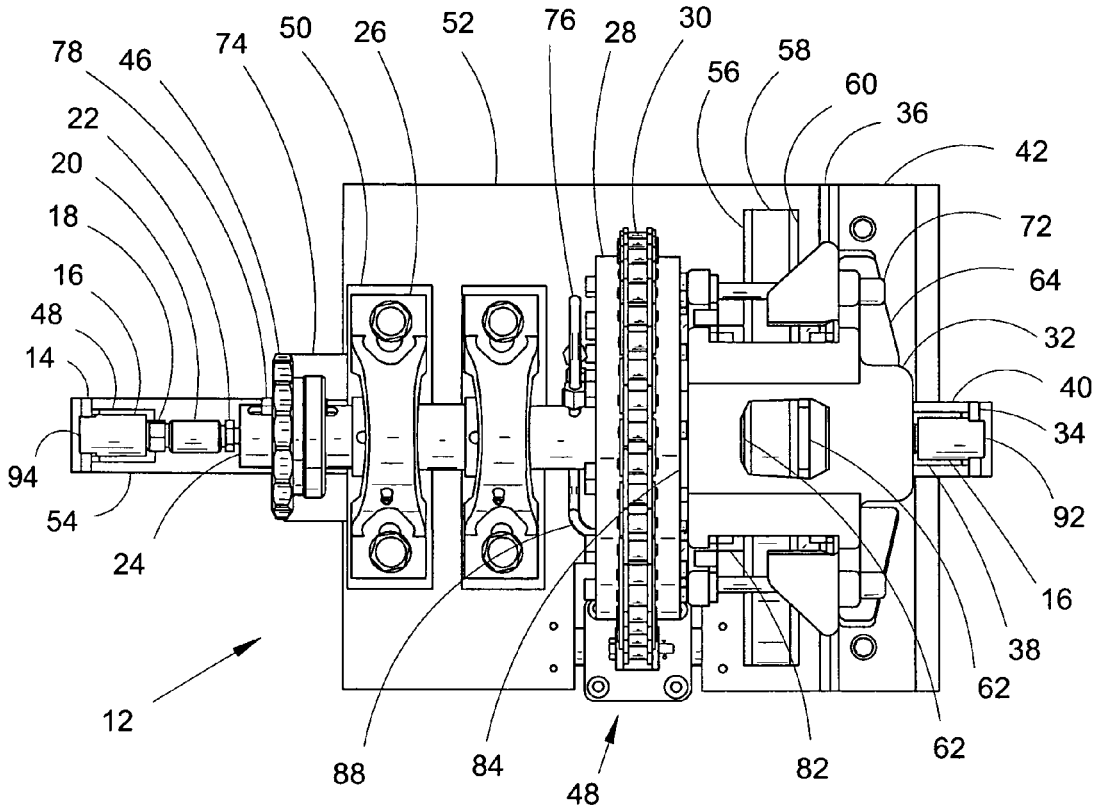
FIG. 5 is a top view.

Cylinder assembly 48 is pivotally mounted beneath an approximately 3 inch by 3 inch notch centered on the front side of base plate 52 as shown in FIGS. 1 and 5. Cylinder assembly 48 is mounted with 2 cylinder mounting brackets 44 attached to the underside of base plate 52. The top of cylinder assembly 48 protrudes through the above mentioned notch and the distal end of the cylinder piston is connected to the proximal end of chain 30 which has a semi-circular large brake pad 28 attached to its under side. Large brake pad 28 has a matching radius to small wheel 70's outer wall and small wheel front plate 66 and small wheel back plate 68 outer walls of approximately 4⅛ inches. Chain 30, with large brake pad 28 attached, is laid over the top of small wheel 70 and the distal end is connected to base plate 52 with chain mount 80 as shown in FIG. 2.

Brake caliper mounting bracket 64 is then attached to the upper back of caliper support plate 36. Attached with caliper mounting bolts 72 to caliper mounting bracket 64 is brake caliper 32 which in C-clamp fashion, positions small brake pads 62 on opposing sides of large wheel inner plate 56 and large wheel outer plate 60 toward their outside perimeters.

Operation:

A standard liquid pump (not shown or part of this invention) of sufficient size to move a large enough volume of liquid through a radiation based space heating system (not shown or part of this invention) to provide the required temperature stability within a given space is selected. It is connected to Brake Furnace 12 as described above at the fixed end of manifold 16, attached at the left end of drive shaft 24. An exit line is attached to manifold 16 at the right end of drive shaft 24, connecting to the circulation line and radiator system (not shown or part of this invention). A standard electric motor (not shown or part of this invention) is connected through drive means 46 that is keyed to drive shaft 24, causing rotation of drive shaft 24 in synchronous rotation with the electric motor. This drive means 46 can be a chain and sprocket, a belt and pulley system or a standard reducing gear train arrangement. A sprocket 46 is shown for illustration purposes. This electric motor can also be used to drive the above described liquid pump. The amount of heat generated by the first stage of Brake Furnace 12 is controlled by the force applied to large brake pad 28 by cylinder assembly 48 pulling chain 30, creating frictional contact between large brake pad 28 and rotating outside wall of small wheel 70. Industry standard hydraulic pumps and controls (not shown) are readily available to adjust the force generated by cylinder assembly 48. Small wheel 70 is rigidly connected to drive shaft 24 by its connection to drive wheel 84 which is also keyed to drive shaft 24. The amount of heat generated by the second stage of Brake Furnace 12 is controlled by the clamping force applied to small brake pads 62 by brake caliper 32. The force against small brake pads 62 is adjustable with standard brake hydraulics (not shown). That force creates frictional contact between small brake pads 62 and rotating large wheel inner plate 56 and large wheel outer plate 60 toward their perimeters where the large wheel is also rigidly connected to drive wheel 84 and therefore rotates with it.

Brake Furnace 12 is described in the above specification by detailing a preferred embodiment with exemplary components. These examples are not intended to limit the size or scope of this invention as material selection, size of components, or choice of drive means are well within the purview of persons skilled in these arts. It is not intended to be limited to this set of materials and dimensions. Rather, the scope of this invention is defined by the following claims.

What is claimed is:

1. A heating system for circulating liquid comprising:

a drive means mounted on a drive shaft;

a plurality of bearings with inside diameters slip fit over said drive shaft;

a small wheel that has an inside diameter, an outside diameter, a perimeter, a thickness, a front surface, a back surface, an annulus, where said small wheel has through holes drilled at a specified radius toward said perimeter every 10 degrees, through said thickness, with grooves milled between adjacent sets of two holes on said front surface and similar grooves milled between offset sets of two holes on said back surface, whereby a front to back and around said small wheel liquid flow path is achieved, a small wheel front plate that has the same outside diameter as said outside diameter of said small wheel and the same inside diameter as said inside diameter of said small wheel, holes drilled and tapped for copper tube fittings for an inlet port and an outlet port on the same radius as said through holes, a small wheel back plate that has the same outside diameter as said small wheel and an inside diameter that provides a slip fit over a small diameter of a drive wheel, four diametrically opposed bolt clearance holes on approximately a 4 inch bolt circle, and a clearance hole for an outlet tube from small wheel;

said drive wheel that has an outside diameter, a step to said small diameter with an inside diameter that slip fits over the outside diameter of said drive shaft and a key slot that is notched into said inside diameter, four diametrically opposed bolt clearance holes on approximately a 4 inch bolt circle, and a clearance hole for said outlet tube from small wheel;

a spacer wheel that has the same outside diameter as said drive wheel and, an inside diameter as to provide a slip fit over said drive shaft, with 4 clearance holes diametrically opposed on an approximately 4 inch bolt circle, and a clearance hole for said outlet tube from small wheel;

a large wheel that has an outside diameter, an inside diameter, a thickness, an inner surface, an outer surface, an annulus, a perimeter, a continuous channel cut through said thickness of said large wheel beginning where a hole, tapped for a copper tube fitting as a large wheel inlet port, from the center of the thickness of said inside diameter penetrates approximately ¼ inch into said annulus of said large wheel, moves in, out and around said large wheel annulus ending with an adjacent hole tapped for a copper tube fitting as a large wheel outlet port, a large wheel inner plate in the shape of an annular ring where the outside diameter is the same as said outside diameter of said large wheel and the inside diameter is a slip fit over said outside diameter of said drive shaft, preferably attached to said large wheel's said inner surface with flat head screws, four diametrically opposed bolt clearance holes on approximately 4 inch bolt circle, and a clearance hole for said outlet tube from small wheel, an outlet tube from small wheel runs parallel to said drive shaft passing through clearance holes in said drive wheel, said spacer wheel, and said large wheel inner plate, turning and entering large wheel at said large wheel inlet port, a large wheel outer plate in the form of an annular ring where the outside diameter matches said outside diameter of said large wheel and the inside diameter matches said inside diameter of said large wheel, preferably attached with flat head screws;

said drive shaft that has a left end, a right end, a centerline, an outside diameter that slip fits in the raceway of said bearings, a drive means keyway towards said left end with a key rigidly connecting said drive means to said drive shaft, a drive wheel keyway towards said right end with a key rigidly connecting said drive wheel to said drive shaft, a coaxially drilled lumen tapped for chuck fitting in said left end of said drive shaft of sufficient depth to clear said drive means and said bearings, a cross drilled hole, tapped for copper tube fitting, that intersects with bottom of said coaxially drilled lumen, said copper tube fitting connected to inlet tube to small wheel and said inlet tube to small wheel is connected to said inlet port fittings on small wheel front plate, a coaxially drilled lumen tapped for chuck fitting in said right end of said drive shaft of a sufficient depth as to center its bottom on the center of said large wheel, a cross drilled hole, tapped for copper tube fitting, that intersects with the bottom of said coaxially drilled lumen, said copper tube fitting connected to outlet tube for large wheel, chuck fittings are attached at said tapped holes in each end of said drive shaft, rotating chucks are attached to the outboard ends of said chuck fittings, manifold fittings are attached to the outboard ends of said rotating chucks, manifolds are attached to the outboard ends of said manifold fittings and have flats on the opposing sides with said flats beginning at outboard end and continuing for the thickness of said left and right end plates;

a base plate with a front side, a back side, a left end, a right end, a top surface, a bottom surface with support bracketing on each end, supporting upstanding left end plates and right end plates with U-shaped slots open from the top, with a width as to provide a slip fit to said flats on the sides of said manifolds at a sufficient height as to allow large wheel to turn freely, a plurality of bearing supports positioned at such a height as to position said bearing centers on the axis of the centerline of said drive shaft and support the rotating mass of said drive shaft and wheels, a cylinder assembly pivotally suspended from said bottom surface of said base plate with body and piston protruding up through notch centered in said front side of said base plate with a chain's proximal end attached to distal end of cylinder piston, a semi-circular brake pad attached on under side of said chain, where said brake pad has matching radius to said small wheel, and distal end of said chain is wrapped over said small wheel and attached to said base plate on said back side with chain mount, and a brake caliper attached to a brake caliper mounting bracket which is attached to a caliper support plate which positions small brake pads against the outer surfaces of said large wheel inner plate and large wheel outer plate toward their top perimeters, whereby heat is generated from the friction caused by applying force to said large brake pad pressing it against said outside wall of said small wheel and additional heat is generated by applying a clamping force on said small brake pads against said large wheel inner and outer plates while said drive shaft is rotated by said drive means, causing synchronous rotation of said small and large wheels and said heat is transferred to a thermally conductive liquid being pumped through said small wheel and said large wheel.

2. A heating system for circulating liquid as in claim 1 wherein the diameter of said through holes and the depth of said milled grooves on the front and back surfaces of said small wheel, the width of said channel cutting through said large wheel, the inside diameter of said drive shaft lumens, fittings, copper tubing, manifolds and rotating chucks are all approximately ¼ inch.

3. A heating system for circulating liquid as in claim 1 wherein said drive means is chosen from the group of sprocket and chain, reducing gear train, or belt and pulley.

* * * * *